US007572996B2

(12) United States Patent
Chi

(10) Patent No.: US 7,572,996 B2
(45) Date of Patent: Aug. 11, 2009

(54) KEYSWITCH STRUCTURE

(75) Inventor: Chih-Yao Chi, Taipei County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 12/117,316

(22) Filed: May 8, 2008

(65) Prior Publication Data

US 2008/0277256 A1 Nov. 13, 2008

(30) Foreign Application Priority Data

May 11, 2007 (TW) ..... 96207612 U

(51) Int. Cl.
*H01H 13/70* (2006.01)

(52) U.S. Cl. ..... 200/344; 200/345

(58) Field of Classification Search ..... 200/344
See application file for complete search history.

(56) References Cited

U.S. PATENT DOCUMENTS 5,247,143 A * 9/1993 Suwa ..... 200/517
6,103,979 A * 8/2000 Motoyama et al. ..... 200/4
6,137,071 A * 10/2000 Yeh et al. ..... 200/344
6,809,278 B2 * 10/2004 Tsubaki ..... 200/341

* cited by examiner

*Primary Examiner*—Renee S Luebke
*Assistant Examiner*—Lheiren Mae A Anglo
(74) *Attorney, Agent, or Firm*—Morris Manning Martin LLP; Tim Tingkang Xia, Esq.

(57) ABSTRACT

The invention discloses a keyswitch, which includes a substrate, a plurality of switches, a keycap, and at least one support. The switches are fixed on the substrate. The keycap thereof defines a bottom surface, which has a plurality of protruding portions, each of which corresponds to one of the switches. In addition, the at least one support is used for supporting the keycap to move vertically relative to the substrate, and each of the at least one support corresponds to one of the switches. Particularly, when the keycap is pressed, the protruding portions and/or the at least one supporting portion can trigger at least one of the switches.

5 Claims, 3 Drawing Sheets

KEYSWITCH STRUCTURE

BACKGROUND OF THE INVENTION

1. Field of the Invention

The present invention relates generally to a keyswitch, and more particularly, to a keyswitch capable of triggering a plurality of switches.

2. Description of the Prior Art

With the popularity of information equipments, lots of information processing apparatus, such as computer, with different brands or types have been used at home, in the office, school and other places. Most of the conventional computers, include desktops and laptops, are equipped with a keyboard for operating by users.

Please refer to FIG. 1A and FIG. 1B, FIG. 1A illustrates a top view of a keyswitch in the prior art; and FIG. 1B is a sectional view along line 0-0 of the keyswitch in FIG. 1A. As shown in FIG. 1A and FIG. 1B, the keyswitch 5 mainly includes a substrate 52, a switch 54, a keycap 56 and a support 58. Moreover, the keycap 56 corresponds to the support 58 and the switch 54. The support 58 can support the keycap 56 moving vertically opposite to the substrate 52. Accordingly, when the keycap 56 is pressed, the support 58 triggers the switch 54.

Conventionally, the keyboard in the prior art has multiple keyswitch, such as "space", "enter" or "shift", which is longer than other regular keyswitches. Please refer to FIG. 2A and FIG. 2B, FIG. 2A illustrates a top view of a multiple key in the prior art; and FIG. 2B is a sectional view along line P-P of the multiple key in FIG. 2A. As shown in FIG. 2A and FIG. 2B, the multiple keyswitch 7 is longer than the keyswitch as shown in FIG. 1A and FIG. 1B, and the multiple keyswitch 7 also includes a substrate 72, a switch 74, a keycap 76 and a support 78. Moreover, the support 78 can support the keycap 76 moving vertically opposite to the substrate 72. When the keycap 76 is pressed, the support 78 can trigger the switch 74.

However, when the keycap 76 of the multiple keyswitch 7 is not pressed at the central area or when it is pressed on the edge, it may tilt and the support 78 may even fail to trigger the switch 74. Furthermore, the same situation may occur when the keyswitch with special shape (not square) such as "enter", is pressed.

With the diversity of keyswitch design, many keyboards are designed to have longer keyswitches or keyswitches with special shape. It is an important issue to solve the above-mentioned problem.

SUMMARY OF THE INVENTION

Accordingly, a scope of the present invention is to provide a keyswitch. Particularly, the keyswitch of the invention corresponds to a plurality of switches and it is capable of triggering at least one of the switches to solve the above-mentioned problem.

According to the first preferred embodiment, the keyswitch includes a substrate, a plurality of switches, a keycap and at least a support. The switches are mounted on the substrate. A bottom surface is defined on the keycap, and a plurality of protruding portions protrude from the bottom surface, and each of the protruding portions corresponds to one of the switches. Moreover, the at least one support corresponds to one of the switches, and the support is used for supporting the keycap moving vertically opposite to the substrate. Particularly, when the keycap is pressed, the protruding portions and/or the support trigger at least one of the switches.

Another scope of the invention is to provide a keyboard which includes the above-mentioned keyswitch.

The keyboard according to the second preferred embodiment of the invention includes a substrate, a plurality of switches, a plurality of keycaps and a plurality of supports. The switches are mounted on the substrate. A bottom surface is defined on each of the keycaps. A first keycap of the keycaps corresponds to N first switches of the switches. Moreover, M protruding portions protrude from the bottom surface of the first keycap, each of the M protruding portions corresponds to one of the N first switches. N is a positive integer larger than 1, and M is a positive integer larger than 1 and smaller than N. Each of the supports corresponds to one of the keycaps and one of the switches, for supporting said corresponded keycap moving vertically opposite to the substrate. At least one of the supports corresponds to one of the N first switches. Particularly, when the keycap is pressed, the M protruding portions and/or the at least one support trigger at least one of the N first switches.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

According to a preferred embodiment, the keyswitch of the invention includes a substrate, a plurality of switches, a keycap and at least a support.

Figure 1A:
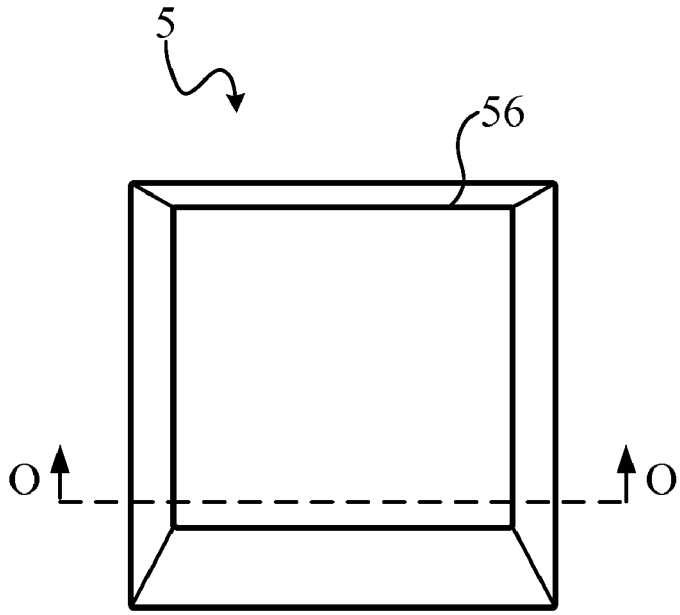
FIG. 1A (prior art)
FIG. 1A illustrates a top view of a keyswitch in the prior art.
Figure 1B:
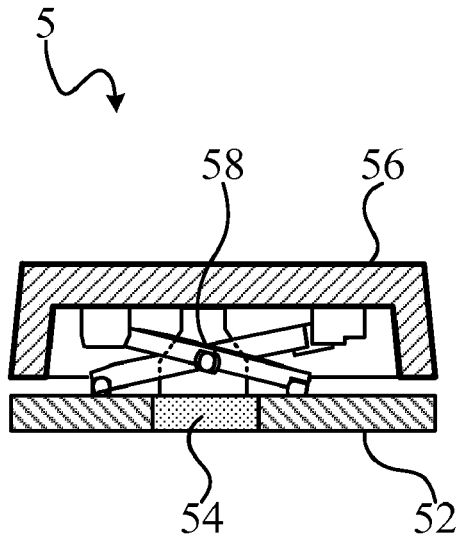
FIG. 1B (prior art)
FIG. 1B is a sectional view along line 0-0 of the keyswitch in FIG. 1A.
Figure 2A:
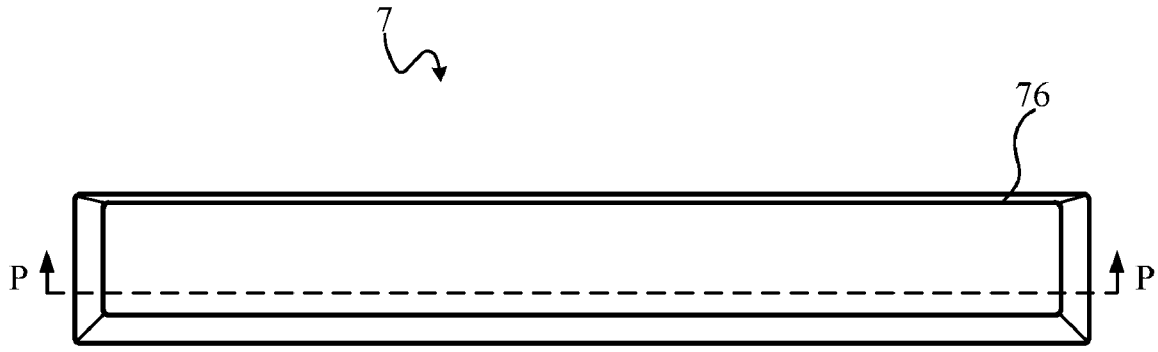
FIG. 2A (prior art)
FIG. 2A illustrates a top view of a multiple key in the prior art.
Figure 2B:
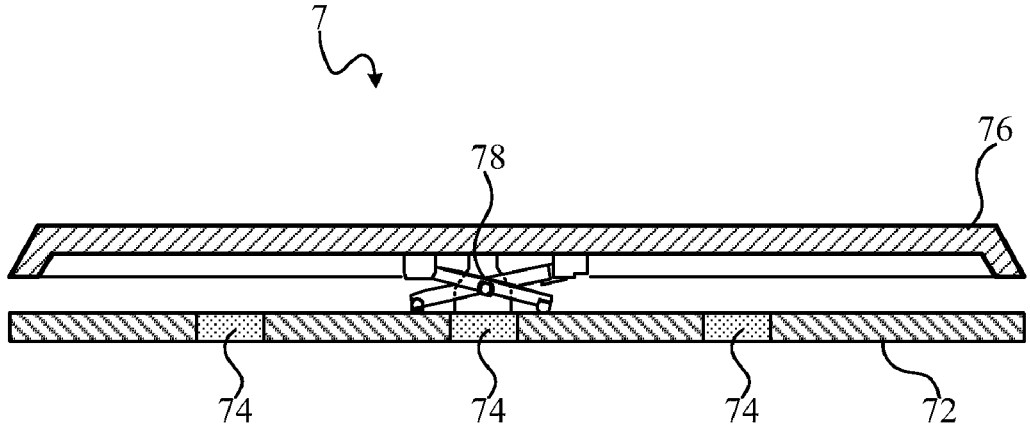
FIG. 2B (prior art)
FIG. 2B is a sectional view along line P-P of the multiple key in FIG. 2A.
Figure 3A:
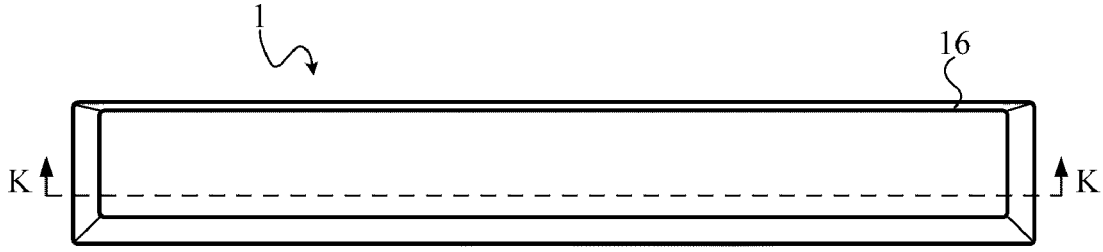
FIG. 3A illustrates a top view of a keyswitch of an embodiment of the invention.
Figure 3B:
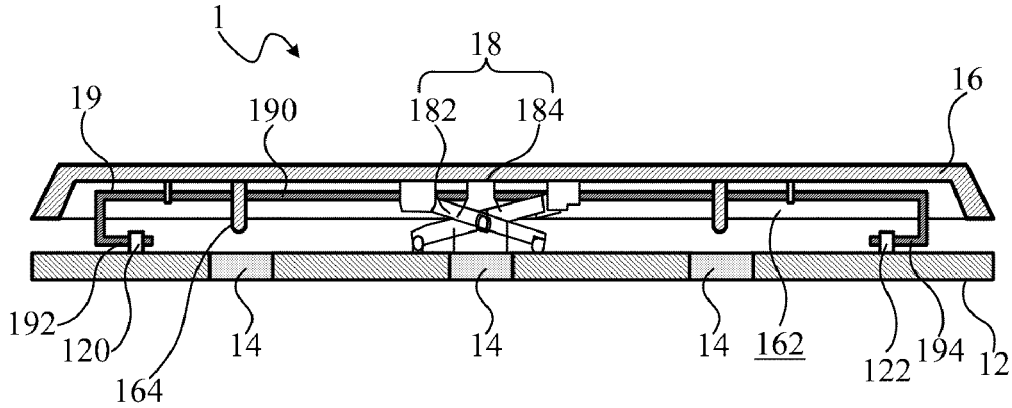
FIG. 3B is a sectional view along line K-K of the keyswitch in FIG. 3A.
Figure 3C:
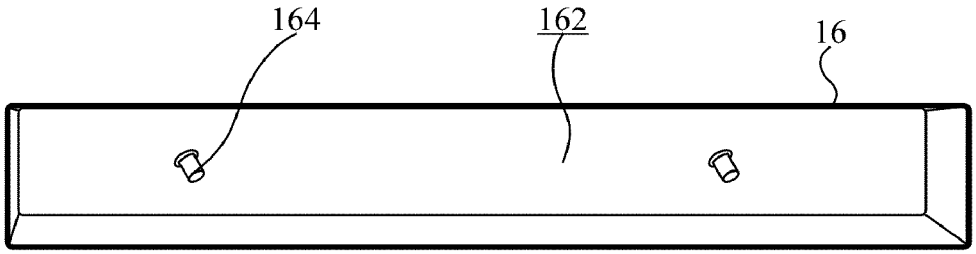
FIG. 3C is a bottom view of the keyswitch in FIG. 3A.

Please refer to FIG. 3A to FIG. 3C, FIG. 3A illustrates a top view of a keyswitch of an embodiment of the invention; FIG. 3B is a sectional view along line K-K of the keyswitch in FIG. 3A; and FIG. 3C is a bottom view of the keyswitch in FIG. 3A. As shown in FIG. 3A to FIG. 3C, the keyswitch 1 includes a substrate 12, three switches 14, a keycap 16 and a support 18.

The switches 14 are mounted on the substrate 12. A bottom surface 162 is defined on the keycap 16, and two protruding portions 164 protrude from the bottom surface 162, each of the protruding portions 164 corresponds to one of the switches 14. The support 18 can be used to support the keycap 16 moving vertically opposite to the substrate 12, and the support 18 corresponds to one of the switches 14. Accordingly, when the keycap 16 is pressed, the protruding portions 164 and/or the support 18 trigger at least one of the switches 14.

In the embodiment, the support 18 includes a scissors-like support 182 and an elastic device 184. The top engagement portion of the scissors-like support 182 is connected to the bottom surface 162 of the keycap 16, whereas the bottom engagement portion of the scissors-like support 182 is connected to the substrate 12. Additionally, the top end of the elastic device 184 contacts the bottom surface 162 of the keycap 16, and the bottom end of the elastic device contacts the switch 14 corresponded to the support 18. Accordingly, when the keycap 16 is pressed, the scissors-like support 182 supports the keycap 16 moving vertically opposite to the substrate 12, and the elastic device 184 triggers the contacted switch 14.

In practice, when the keyswitch is a multiple keyswitch such as "space" or "shift"; or keyswitch with special shape (not square) such as "enter", it can further include a balance member 19. The balance member 19 has an axle 190 defining a first end and a second end opposite to the first end. The axle 190 is folded with a first angle and elongated from the first end to form a first side 192, and the axle 190 is folded with a second angle and elongated from the second end to form a second side 194. Furthermore, the axle 190 is mounted to the bottom surface 162 of the keycap 16, and the first side 192 and the second side 194 of the axle 190 are connected to a first connecting member 120 and a second connecting member 122 on the substrate 12 respectively. When the keycap 16 is pressed, the balance member 19 and the scissors-like support can support the keycap moving vertically opposite to the substrate, and can completely drive the movement of the keycap.

In practice, the keycap of the invention is formed of plastic material. However, in practice, the keycap of the invention can be formed of other suitable material.

Another embodiment of the invention discloses a keyboard which includes the above-mentioned keyswitch. The keyboard in the embodiment includes a substrate, a plurality of switches mounted on the substrate, a plurality of keycaps and a plurality of supports Each of the keycaps is defined a bottom surface, and a first keycap of the keycaps corresponds to N first switches of the switches. Moreover, M protruding portions protrude from the bottom surface of the first keycap, each of the M protruding portions corresponds to one of the N first switches. N is a positive integer larger than 1, whereas M is a positive integer larger than 1 and smaller than N. Each of the supports corresponds to one of the keycaps and one of the switches, the supports can support the keycaps moving vertically opposite to the substrate. Particularly, at least one of the supports corresponds to one of the N first switches. Accordingly, when the first keycap is pressed, the M protruding portions and/or the at least one support trigger at least one of the N first switches.

For example, the above-mentioned first keycap corresponds to five first switches, and the first keycap has three protruding portions correspond to three of the first switches. Moreover, two supports correspond to the first keycap and the other two first switches.

Practically, the support can include a scissors-like support and an elastic member. The top engagement portion of the scissors-like support is connected to the bottom surface of the first keycap, whereas the bottom engagement portion of the scissors-like support is connected to the substrate. Additionally, the top end of the elastic device contacts the bottom surface of the first keycap, and the bottom end of the elastic device contacts the switch corresponded to the support. Accordingly, when the first keycap is pressed, the scissors-like support supports the first keycap moving vertically opposite to the substrate, and the elastic device triggers the contacted switch.

As mentioned above, when the first keycap is the keycap of a multiple keyswitch such as "space" or "shift"; or the keycap of a keyswitch with special shape (not square) such as "enter", the keyboard can further include a balance member. The balance member has an axle defining a first end and a second end opposite to the first end. The axle is folded with a first angle and elongated from the first end to form a first side, and the axle is folded with a second angle and elongated from the second end to form a second side. Furthermore, the axle is mounted to the bottom surface of the first keycap, and the first side and the second side of the axle are connected to a first connecting member and a second connecting member on the substrate respectively. When the first keycap is pressed, the balance member and the scissors-like support can support the first keycap moving vertically opposite to the substrate, and can completely drive the movement of the first keycap.

In practice, the first keycap is formed of plastic material. However, in practice, the first keycap can be formed of other suitable material. Moreover, other keycaps of the keyboard can be formed of plastic material or other suitable material.

To sum up, because of the keyswitch of the invention can correspond to a plurality of switches, and the bottom surface of the keycap of the keyswitch has a plurality of protruding portions corresponding to the switches, at least one of the switches can be certainly triggered whether the user presses on any area of the keycap.

Although the present invention has been illustrated and described with reference to the preferred embodiment thereof, it should be understood that it is in no way limited to the details of such embodiment but is capable of numerous modifications within the scope of the appended claims.

What is claimed is:

1. A keyboard comprising:

a substrate;

a plurality of switches being mounted on the substrate;

a plurality of keycaps, each of the keycaps defining a bottom surface, a first keycap of the keycaps corresponding to N first switches of the switches, and M protruding portions protruding from the bottom surface of the first keycap, each of the M protruding portions corresponding to one of the N first switches, N being a positive integer larger than 1, M being a positive integer larger than 1 and smaller than N; and a plurality of supports, each of the supports corresponding to one of the keycaps and one of the switches, for supporting said corresponded keycap moving vertically opposite to the substrate, and at least one of the supports corresponding to one of the N first switches;

wherein when the first keycap is pressed, the M protruding portions and/or the at least one support triggering at least one of the N first switches.

2. The keyboard of claim 1, further comprising:

a balance member having an axle defining a first end and a second end opposite to the first end, the axle being folded with a first angle and elongated from the first end to form a first side, and the axle being folded with a second angle and elongated from the second end to form a second side;

wherein the axle is mounted to the bottom surface of the keycap, and the first side and the second side are connected to a first connecting member and a second connecting member on the substrate respectively.

3. The keyboard of claim 1, wherein each of the supports comprises an elastic device, the top end of the elastic device contacting the bottom surface of the keycap, and the bottom end of the elastic device contacting the switch corresponding to the support; wherein when the keycap is pressed, the elastic device triggering said contacted switch.

4. The keyboard of claim 1, wherein the at least one support comprises a scissors-like support.

5. The keyboard of claim 1, wherein the keycap is formed of plastic material.

* * * * *